United States Patent [19]

Bennis

[11] Patent Number: 4,867,358

[45] Date of Patent: Sep. 19, 1989

[54] BEVERAGE CONTAINER ASSEMBLY

[76] Inventor: Paul A. Bennis, 241 Fairhaven Dr., Lower Burrell, Pa. 15068

[21] Appl. No.: 222,048

[22] Filed: Jul. 21, 1988

[51] Int. Cl.[4] ..... A45F 5/02

[52] U.S. Cl. ..... 224/148; 224/197; 224/226; 224/272

[58] Field of Search ..... 224/148, 191, 195, 196, 224/197, 199, 224, 226, 240–242, 282, 42.45 R, 252, 262, 269, 272; 215/12.1, 13.1, 12.2, DIG. 7; 220/85 H, 903

[56] References Cited

U.S. PATENT DOCUMENTS

| | | | |
|---|---|---|---|
| 1,445,642 | 2/1923 | O'Neill | 224/197 |
| 2,387,900 | 11/1945 | Hartwell | 224/197 |
| 3,120,319 | 2/1964 | Buddrus | 215/12.2 |
| 3,389,784 | 6/1968 | Hendricks et al. | 224/148 |
| 3,743,147 | 7/1973 | Wilczynski | 224/272 |
| 4,088,250 | 5/1978 | Schaefer | 220/85 H |
| 4,197,890 | 4/1980 | Simko | 383/97 |
| 4,228,908 | 10/1980 | Tweeton | 215/11.6 |
| 4,718,586 | 1/1988 | Hagino | 224/197 |

FOREIGN PATENT DOCUMENTS

| | | | |
|---|---|---|---|
| 289213 | 6/1953 | Switzerland | 215/12 |

*Primary Examiner*—Henry J. Recla
*Assistant Examiner*—J. Casimer Jacyna

[57] ABSTRACT

A beverage container assembly pivotably attachable to a person's clothing (e.g. his belt) so the liquid can be poured from the container by tilting the assembly in a forward direction. The closure for the liquid container can be used as a drinking cup.

1 Claim, 1 Drawing Sheet

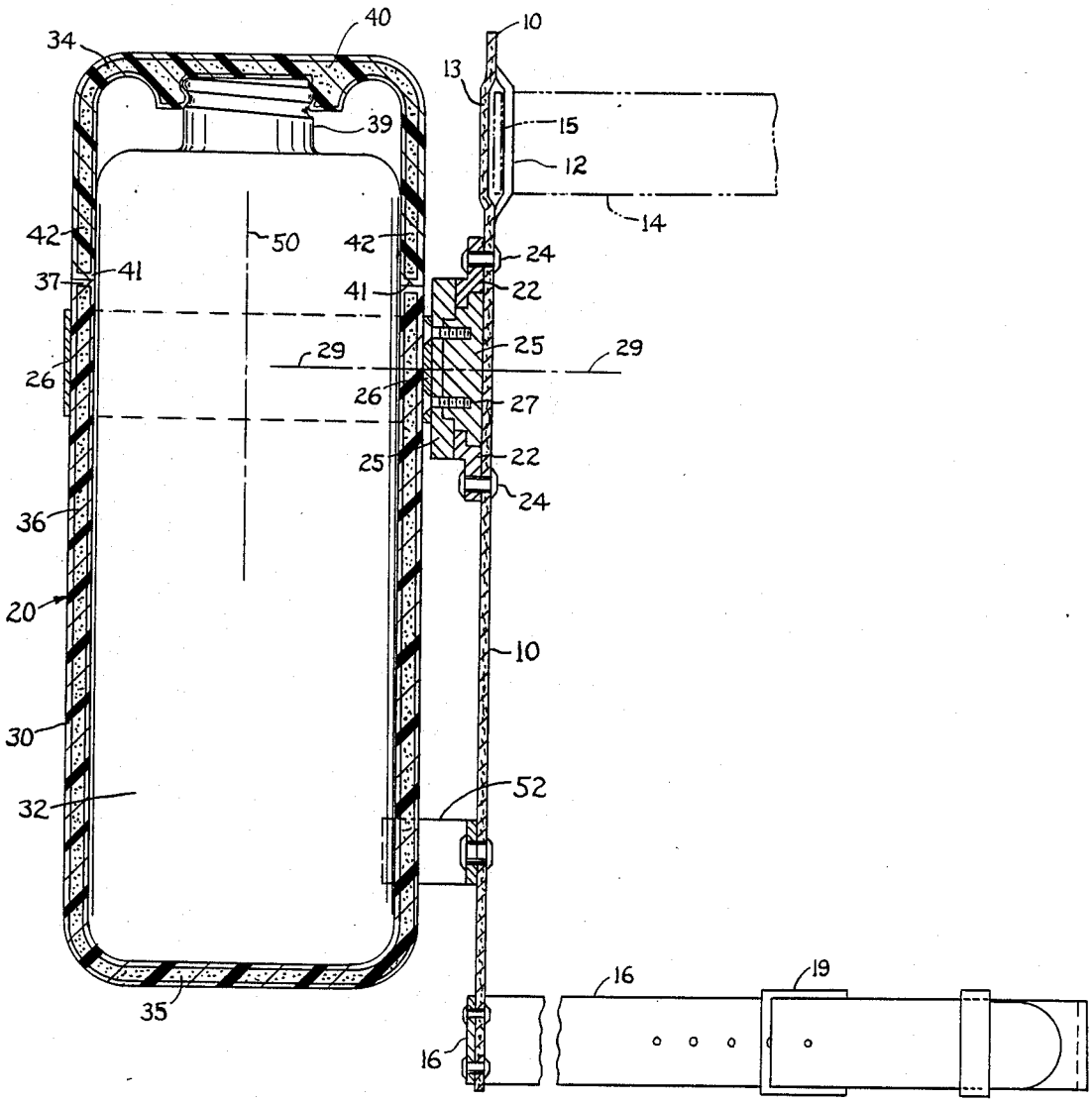
40
34
10
13
39
15
12
14
42
50
42
24
37
41
41
22
29
25
29
26
26
27
25
22
24
36
20
10
30
52
32
16
19
35
16

BEVERAGE CONTAINER ASSEMBLY

BACKGROUND OF THE INVENTION

This invention relates to a beverage container assembly, particularly a beverage container assembly that can be attached to person's clothing for ready access when the person wishes to consume the contained beverage. The beverage container assembly would be especially useful to outdoorsmen, hikers, skiers and others who wish to keep a beverage container handy while moving from place to place on foot.

SUMMARY OF THE INVENTION

The invention contemplates a beverage container assembly that has a pivotal attachment to a person's belt, whereby the container is located on the person's hip area in a readily accessible position. The container assembly includes a cup-like closure for a liquid-container bottle; after the cup-like closure has been unscrewed from the bottle the bottle can be pivoted from an upright position on the person's hip to a forwardly-tilted position for pouring the liquid into the cup (closure).

The container assembly provides a source of liquid and also a drinking cup for consuming the liquid; a separate drinking cup is not required. The container is always retained on the person's hip; it does not have to be set down on a support surface or picked up after usage for drinking purposes. The container cannot be mislaid or inadvertently left behind.

Preferably the container assembly includes a thermal jacket around the bottle, whereby a person can fill the container with hot or cold liquid at the start of the day and then journey into distant areas, knowing the liquid will still be hot (or cold) later in the day.

The container assembly preferably includes strap means designed to encircle the person's pant leg area, to stabilize the liquid container against swinging or jiggling while the person is walking or running. The assembly is relatively light in weight so as not to be a physical burden on the person while he is walking about.

THE DRAWINGS

The single FIGURE is a sectional view taken through a beverage container assembly embodying my invention.

DESCRIPTION OF A PREFERRED EMBODIMENT OF THE INVENTION

The single FIGURE of the drawing shows a beverage container assembly that includes a panel 10, preferably formed of leather or other flexible material that can flex or bend so as to conform to the hip area of the person utilizing the assembly. Near its upper end panel 10 has two parallel vertical slits that form an island-like section 12 designed to lie behind the person's belt 14. Installation of the container assembly on the person's belt can be accomplished by threading the belt through space 16 between panel sections 12 and 13, such that panel 10 is suspended from the person's belt; preferably panel 10 rests (or seats) against the person's hip.

A flexible strap 16 is connected to panel 10 near its low end for encirclement of the person's pant leg area; a conventional buckle structure 19 is provided so that the strap can be opened for placement around the pant leg. Strap 16 stabilizes panel 10 against swinging or otherwise moving away from its intended position on the person's hip.

Panel 10 has a pivotable connection with a beverage container unit 20. The necessary pivot structure includes an annular metallic member 22 attached to panel 10 via rivets 24, and an annular metallic member 25 attached to a steel ring 26 via screws 27. Member 25 is a-two-piece structure wherein one piece has a press fit in the other piece. Members 22 and 25 are circular members that can rotate on one another around a central pivot axis 29.

Beverage container unit 20 comprises a hollow casing 30, a bottle 32 removably disposed within casing 30, and a cup-like closure 34 for bottle 32. Casing 30 and closure 34 are formed of a material having thermal insulation properties to provide complete thermal barrier around bottle 32. The bottle may, or may not, have thermal insulating properties.

Casing 30 comprises a bottom wall 35 and an annular side wall 36. Wall 36 terminates in an open mouth 37 that permits bottle 32 to be inserted into the cavity circumscribed by wall 36. Steel ring 26 is adhesively attached to the outer surface of casing 30.

Bottle 32 is longer than the axial dimension of casing 30 such that neck section 39 of the bottle projects beyond casing mouth 37 when the bottle is fully inserted into the casing.

Bottle closure 34 comprises an end wall 40 and annular side wall 42. End wall 40 has an internally threaded section designed to mesh with an external thread on bottle neck section 39. Accordingly, closure 34 can be turned around bottle axis 50 to close the liquid passage that extends through neck section 39.

The diameter of closure 34 is substantially the same as that of casing 30 so that when closure 34 is screwed onto neck section 39 of the bottle the rim or mouth surface 41 formed by wall 42 will be in close adjacency to mouth surface 37 of casing 30. This arrangement ensures that casing 30 and bottle closure 34 will provide a complete thermal barrier around bottle 32.

When closure 34 is unscrewed from bottle 32 it can be used as a drinking cup. To pour liquid from bottle 32 into cup (closure) 34 the casing 30 is grasped manually and tilted around axis 29 so that neck section 39 moves downwardly and forwardly to discharge the liquid into the cup. After the beverage is consumed the cup (closure) 34 can be placed back onto the bottle.

Bottle 32 may be frictionally retained in casing 30, in the same fashion as described in U.S. Pat. No. 3,120,319 to D. Buddrus. Closure 34 and casing 30 are preferably formed of a closed cell foam material having a smooth non-porous plastic skin.

During times when the person is not using the beverage container assembly for drinking purposes container unit 20 assumes an upright position, (with bottle axis 50 essentially vertical). A spring clip 52 may be mounted on panel 10 to frictionally engage the side surface of casing 30 for releasably retaining the unit in the desired position.

The drawings shows one particular form that the invention can take. Other forms are possible.

I claim:

1. A beverage container assembly attachable to a person's clothing comprising:

a vertically elongated flexible panel adapted to lie against a person's hip and leg area; means (at 13) for attaching said panel to the person's belt; a strap means (16) connected to a lower section of said panel for encirclement of the person's pant leg area to thereby retain the panel in a stabilized position on the person's hip and leg area;

a vertically elongated beverage container unit located in close adjacency to an outer face of said flexible panel;

means pivotably attaching said beverage container unit to said panel, whereby the container unit is pivotable between a normal vertical upright position and a forwardly tilted pouring position;

said pivotable attaching means comprising first and second engaged pivot members rotatable on one another around a pivot axis extending normal to the panel at a point just below the belt attaching means (13); said first pivot member being affixed to said panel; said second pivot member being affixed to said beverage container unit;

said beverage container unit comprising a hollow rigid casing (30), a bottle disposed within the casing, and a rigid closure for the bottle;

said hollow casing comprising a bottom wall, and an annular side wall terminating in an open mouth (37) at a point just above the pivot axis, when the beverage container unit is in its normal upright position;

said bottle having a reduced diameter neck section that projects beyond the mouth of the hollow casing when the bottle is fully inserted into the casing;

said bottle closure comprising an end wall engageable with the bottle neck section to prevent liquid outflow from the bottle, and an annular side wall that terminates in an annular mouth surface (41) that is in close adjacency to the mouth of the hollow casing when the closure is installed on the bottle;

said bottle closure being adapted to serve as a drinking cup when it is removed from the bottle;

said hollow casing and bottle closure having thermal insulating properties to thereby provide a complete thermal barrier around the bottle.

* * * * *